US006232050B1

(12) United States Patent
Hirai et al.

(10) Patent No.: US 6,232,050 B1
(45) Date of Patent: May 15, 2001

(54) METHOD FOR FORMING COLOR IMAGE

(75) Inventors: Hiroyuki Hirai; Takuya Yokokawa, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/587,514

(22) Filed: Jun. 5, 2000

(30) Foreign Application Priority Data

Jun. 4, 1999 (JP) ..... 11-158694

(51) Int. Cl.[7] ..... G03C 7/30
(52) U.S. Cl. ..... 430/383; 430/494
(58) Field of Search ..... 430/383, 394

(56) References Cited

U.S. PATENT DOCUMENTS

| | | | | |
|---|---|---|---|---|
| 4,705,745 | | 11/1987 | Kitchin et al. | 430/505 |
| 4,824,770 | | 4/1989 | Kitchin et al. | 430/363 |
| 5,703,436 | * | 12/1997 | Forrest et al. | 313/506 |

* cited by examiner

*Primary Examiner*—Hoa Van Le
(74) *Attorney, Agent, or Firm*—Sughrue, Mion, Zinn, Macpeak & Seas, PLLC

(57) ABSTRACT

Disclosed is a method for forming a color image comprising exposing a color photographic material, wherein the color photographic material comprises a support having provided thereon at least (1) a photosensitive layer capable of forming a yellow image by imagewise exposure and processing, (2) a photosensitive layer capable of forming a magenta image by imagewise exposure and processing, and (3) a photosensitive layer capable of forming a cyan image by imagewise exposure and processing, each of said photosensitive layers is sensitive to the radiant rays in the range of from 380 to 900 nm, each photosensitive layer has different wavelength corresponding to the maximum spectral sensitivity, the maximum spectral sensitivities of photosensitive layers (1) to (3) gradually diminish from the photosensitive layer having the maximum spectral sensitivity at the shortest wavelength to the photosensitive layer having the maximum spectral sensitivity at the longest wavelength, and exposure is performed by using at least three organic light emitting devices, wherein said at least three organic light emitting devices are in dot array state each having peak wavelength of emission spectrum within the wavelength region corresponding to the spectral sensitivity of each photosensitive layer, and the emission strengths of emission spectra of said organic light emitting devices gradually increase from the organic light emitting device emitting light at the shortest wavelength region to the organic light emitting device emitting light at the longest wavelength region.

5 Claims, 3 Drawing Sheets

SPECTRAL SENSITIVITY OF PHOTOGRAPHIC MATERIAL NO. 101

SPECTRAL SENSITIVITY OF PHOTOGRAPHIC MATERIAL NO. 102

DOT ARRAY STATE ORGANIC LIGHT EMITTING DEVICE

METHOD FOR FORMING COLOR IMAGE

FIELD OF THE INVENTION

The present invention relates to a method for forming a color image by using an organic light emitting device as an exposure light source, and particularly relates to a method for forming a color image comprising digital exposure in accordance with image data using a linear organic light emitting device and development process to obtain an image.

BACKGROUND OF THE INVENTION

Laser diode (LD) and inorganic light emitting diode (LED) known as the light emitting device are well known as exposure light sources for writing on a photographic material. However, the emission wavelengths of LD and LED cannot be changed easily, in particular, there is almost no room of selection in the wavelength of blue light emitting device. The organic light emitting device has been eagerly studied since 1980 due to the advantage of a thin film light emitting device and the use as the exposure light source has been discussed. For example, as disclosed in JP-A-7-22649 (the term "JP-A" as used herein means an "unexamined published Japanese patent application"), it has been suggested to use the organic light emitting device for exposure of generally commercially available photographic films and films for instant cameras by means of a photorecording apparatus provided with a plurality of lines of organic light emitting devices arranged in dot array classified by luminescent colors. The organic light emitting device is easy to obtain arbitrary emission spectrum and arrange in dot array, and design with less moving parts is practicable, therefore, it can be preferably used as an exposure light source.

However, in a silver halide photographic material having at least three spectral sensitivities in the radiant rays of the region of from 400 to 900 nm, the emission spectrum of the exposure light source is particularly important, and there are problems that when exposure is performed using ordinary organic light emitting devices having broad half band widths, color turbidity (a negative photographic material) or color blank (a positive photographic material) are generated, and color reproduction of the image is deteriorated. It has been found that this phenomenon is attributed to the fact that when silver halide is spectrally sensitized with a sensitizing dye, a sensitivity peak acutely descending is generally formed on the longer wavelength side not on the short wavelength side, on the other hand, when an organic light emitting device is used, the emission spectrum is generally steep on the short wavelength side not on the long wavelength side.

SUMMARY OF THE INVENTION

In view of the above-described actual circumstances, an object of the present invention is to provide a method of obtaining a color image showing good color reproduction by the steps comprising exposing a photosensitive material in accordance with image data with an organic light emitting device and development processing the material.

Another object of the present invention is to provide a method for forming a color image with a thin and light weight exposure means with less moving parts.

The above object of the present invention has been attained by the following means.

(1) A method for forming a color image comprising exposing a color photographic material, wherein the color photographic material comprises a support having provided thereon at least (1) a photosensitive layer capable of forming a yellow image by imagewise exposure and processing, (2) a photosensitive layer capable of forming a magenta image by imagewise exposure and processing, and (3) a photosensitive layer capable of forming a cyan image by imagewise exposure and processing, each of said photosensitive layers is sensitive to the radiant rays in the range of from 380 to 900 nm, each photosensitive layer has different wavelength corresponding to the maximum spectral sensitivity, the maximum spectral sensitivities of photosensitive layers (1) to (3) gradually diminish from the photosensitive layer having the maximum spectral sensitivity at the shortest wavelength to the photosensitive layer having the maximum spectral sensitivity at the longest wavelength, and exposure is performed by using at least three organic light emitting devices, wherein said at least three organic light emitting devices are in dot array state each having peak wavelength of emission spectrum within the wavelength region corresponding to the spectral sensitivity of each photosensitive layer, and the emission strengths of emission spectra of said organic light emitting devices gradually increase from the organic light emitting device emitting light at the shortest wavelength region to the organic light emitting device emitting light at the longest wavelength region.

(2) The method for forming a color image as described in the above item (1), wherein the color photographic material further has the fourth photosensitive layer (sensitive to radiant rays in the range of from 380 to 900 nm) capable of forming or compensating for a black image by imagewise exposure and processing, and exposure is performed by further using the fourth dot array state organic light emitting device corresponding to the fourth photosensitive layer.

(3) The method for forming a color image as described in the above item (1) or (2), wherein the sensitivity difference between the photosensitive layer having the maximum spectral sensitivity at the shortest wavelength and the photosensitive layer having the maximum spectral sensitivity at the longest wavelength is larger than 0.2 log light exposure unit.

(4) The method for forming a color image as described in the above item (1), (2) or (3), wherein each dot of each dot array state organic light emitting device emits light in at least eight scattered levels and exposure of the photosensitive layer is performed correspondingly in at least eight scattered levels.

(5) The method for forming a color image as described in any of the above items (1) to (4), wherein the wavelengths corresponding to the maximum spectral sensitivities of said photosensitive layers of said color photographic material are at least 50 nm apart from one another.

DETAILED DESCRIPTION OF THE INVENTION

Figure 1:
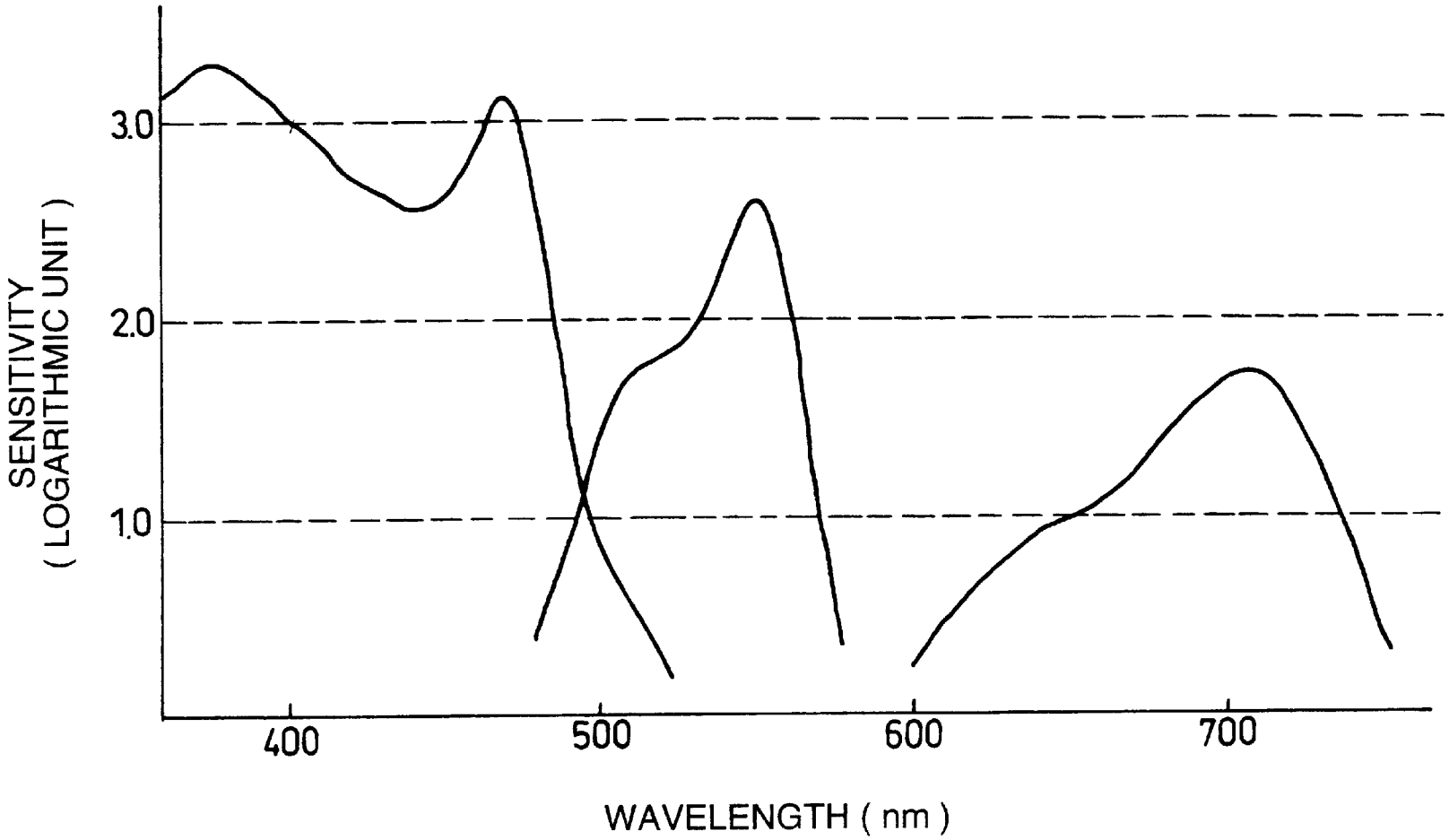
FIG. 1 is a spectral graph showing the spectral sensitivity of Photographic Material No. 101.

The present invention will be described in detail below.

As the photographic material for use in the present invention, silver trigger type color photographic materials (e.g., materials described in *Kochi Gijutsu*, No. 5, published by Aztec Co., Ltd., Mar. 22, 1991), and non-silver photographic materials (e.g., materials wherein image is formed by dry process such as heat and pressure such as Cycolor (trade name)) can be exemplified besides silver halide color photographic materials. For obtaining wide range of colors in the chromaticity diagram by using three primary colors of yellow, magenta and cyan, the photographic material for use in the present invention generally has spectral sensitivities in three regions in the range of from 380 to 900 nm, and coloring materials of yellow, magenta and cyan are combined with each region. Since the silver halide color photographic material for producing a color filter as disclosed in JP-A-8-22108 and the silver halide color photographic material for color-proof as disclosed in JP-B-6-93100 (the term "JP-B" as used herein means an "examined Japanese patent publication") require a black color sufficient density, the fourth region is provided with spectral sensitivity to compensate for black.

The smaller the energy which is necessary to be photosensitizer, the more preferred is the photographic material for use in the present invention, because the power of a light source can be made smaller, as a result, the life of the organic light emitting device becomes prolonged. Accordingly, it is particularly preferred in the present invention to be combined with a silver halide color photographic material providing high sensitivity. The silver halide color photographic material may be negative or positive.

The silver halide color photographic material for use in the present invention (hereinafter referred to as "photographic material of the present invention") provides a dye image by various processes such as a color coupling process, a dye diffusion transfer process, a silver dye bleach process or a leuco dye process.

Silver halide grains which can be used in the photosensitive material of the present invention include silver chloride, silver bromide, silver iodochloride, silver chlorobromide, silver iodobromide, and silver iodochlorobromide. The content of silver iodide is preferably 2 mol % or less, more preferably 1 mol % or less.

Silver halide emulsions for use in the present invention may be surface latent image type or internal latent image type. The internal latent image type emulsion is used as the direct reversal emulsion by being combined with a nucleating agent and a photo-fogging agent. The crystal structure may be uniform, or may be multi-structural wherein the interior and exterior parts of the grains may be comprised of different halogen compositions. Silver halides which have different compositions may be joined by epitaxial junction or may be joined with compounds other than a silver halide, such as silver thiocyanate or lead oxide.

The high silver chloride emulsion for use in the present invention may have such a structure that a silver bromide localized phase is present inside and/or on the surface of the silver halide grains in the form of a layer or a non-layer as described above. Such a silver bromide localized phase may occur inside of the grains, or at edges, corners or on planes of the grains, and a silver bromide localized phase joined at corners of the grain is preferred.

The average grain size of the silver halide grains for use in the present invention is preferably from 0.05 to 2.5 $\mu$m, particularly preferably from 0.1 to 1.5 $\mu$m. Tabular grains preferably have a thickness of from 0.05 to 1.5 $\mu$m, particularly preferably from 0.1 to 1.0 $\mu$m.

Monodispersed emulsions having a narrow grain size distribution may be used. The monodispersed emulsion is a silver halide emulsion having a grain size distribution that at least 80% of which have a grain size within ±30% of the average grain size in terms of the weight or number of silver halide grains. Monodispersed silver halide emulsions having a variation coefficient of 20% or less, particularly 15% or less, are preferably used.

Polydispersed emulsions having broad grain size distribution may also be used.

The silver halide photographic emulsions for use in the present invention can be prepared using the methods disclosed, for example, in *Research Disclosure* (hereinafter abbreviated to *RD*), Vol. 176, No. 17643 (December, 1978), pages 22 and 23, "I. Emulsion Preparation and Types", *RD*, No. 18716 (November, 1979), page 648, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

Internal latent image type emulsions and silver halide grains which can be used in the direct positive photographic materials such as auto-positive color films are disclosed in JP-A-63-81337 and JP-A-1-282545. The internal latent image type emulsions may be a core/shell type or a conversion type, but a core/shell type emulsion is preferably used.

The monodispersed emulsions disclosed in U.S. Pat. Nos. 3,574,628, 3,655,394 and British Patent 1,413,748 are also preferred.

Further, tabular grains having an aspect ratio of about 5 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

Grains having various crystal forms may be used in admixture.

A photosensitive silver halide emulsion of the present invention is generally chemically sensitized. For the chemical sensitization of a photosensitive silver halide emulsion of the present invention, chalcogen sensitization, e.g., sulfur sensitization, selenium sensitization and tellurium sensitization, noble metal sensitization using gold, platinum and palladium, and reduction sensitization can be used alone or in combination (e.g., JP-A-3-110555 and JP-A-5-238667). Chemical sensitization can be carried out in the presence of a nitrogen-containing heterocyclic compound (e.g., JP-A-62-253159). Further, an antifoggant which is described later can be added after termination of chemical sensitization. Specifically, methods disclosed in JP-A-5-45833 and JP-A-62-40446 can be used.

pH during chemical sensitization is preferably from 5.3 to 10.5, more preferably from 5.5 to 8.5, and pAg is preferably from 6.0 to 10.5, more preferably from 6.8 to 9.0.

The coating amount of the photosensitive silver halide emulsion for use in the present invention is from 1 mg to 10 g/m$^2$ in terms of silver.

For imparting spectral sensitivity of green sensitivity, red sensitivity and infrared sensitivity to a photosensitive silver halide emulsion for use in the present invention, the photosensitive silver halide emulsion is spectrally sensitized using methine dyes and other dyes. If necessary, a blue-sensitive emulsion may be spectrally sensitized in a blue region.

Dyes which are used for the purpose include a cyanine dye, a merocyanine dye, a complex cyanine dye, a complex merocyanine dye, a holopolar cyanine dye, a hemicyanine dye, a styryl dye, and a hemioxonol dye.

Specifically, sensitizing dyes disclosed in U.S. Pat. No. 4,617,257, JP-A-59-180550, JP-A-64-13546, JP-A-5-45828 and JP-A-5-45834 can be exemplified.

These sensitizing dyes can be used either alone or in combination, and the combination of sensitizing dyes is often used, in particular, for the purpose of supersensitization and the wavelength control of spectral sensitivity.

A dye having no spectral sensitizing function by itself or a compound which does not substantially absorb visible light but shows supersensitization may be contained in emulsions together with sensitizing dyes (e.g., those disclosed in U.S. Pat. No. 3,615,641 and JP-A-63-23145).

These sensitizing dyes may be added to emulsions before, during or after chemical sensitization, alternatively they may be added before or after the nucleation of silver halide grains as disclosed in U.S. Pat. Nos. 4,183,756 and 4,225,666. Sensitizing dyes and supersensitizers may be added as a solution of organic solvent, e.g., methanol, as a gelatin dispersion, or as a solution of surfactant. The addition amount is generally from about $10^{-8}$ to $10^{-2}$ mol per mol of the silver halide.

Additives for use in these processes are disclosed in *Research Disclosure*, No. 17643, ibid., No. 18716, and ibid., No. 307105, and the locations related thereto are summarized in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 648, right column | page 868 |
| 5. Antifoggants and Stabilizers | pages 24–25 | page 649, right column | pages 868–870 |
| 6. Light Absorbers, Filter Dyes, and Ultraviolet Absorbers | pages 25–26 | page 649, right column to page 650, left column | page 873 |
| 7. Dye Image Stabilizers | page 25 | page 650, left column | page 872 |
| 8. Hardening Agents | page 26 | page 651, left column | pages 874–875 |
| 9. Binders | page 26 | page 651, left column | pages 873–875 |
| 10. Plasticizers and Lubricants | page 27 | page 650, right column | page 876 |
| 11. Coating Aids and Surfactants | pages 26–27 | page 650, right column | pages 875–876 |
| 12. Antistatic Agents | page 27 | page 650, right column | pages 876–877 |

Each photosensitive layer of the photographic material according to the present invention is sensitive to the radiant rays in the range of from 380 to 900 nm, has different wavelength corresponding to the maximum spectral sensitivity, and the maximum spectral sensitivities of these photosensitive layers gradually diminish from the photosensitive layer having the maximum spectral sensitivity at the shortest wavelength to the photosensitive layer having the maximum spectral sensitivity at the longest wavelength. The sensitivity difference between the photosensitive layer having the maximum spectral sensitivity at the shortest wavelength and the photosensitive layer having the maximum spectral sensitivity at the longest wavelength is preferably larger than 0.2 log light exposure unit, more preferably 0.5 log light exposure unit.

The wavelengths corresponding to the maximum spectral sensitivities of the photosensitive layers of the photographic material according to the present invention are necessary to be at least 50 nm apart from one another, more preferably 80 nm.

Color developers which can be used in the present invention are not particularly limited so long as the oxidation product of the developers formed by developing silver halide can form cyan, magenta and yellow dyes by coupling reaction with couplers, and these compounds are well known in the industry. Specific examples of color developers are described in T. H. James, *The Theory of the Photographic Process,* 4th Ed., pp. 291 to 334 and 353 to 361, *RD*, No. 17643, pp. 28 and 29 (December, 1978), and ibid., No. 18716, p. 651 (November, 1979). Particularly preferred color developer is a p-phenylenediamine derivative.

Couplers which can be used in the present invention may be of the coupler-in-developer type which are used by being dissolved in a color developing solution with the above developer, or may be of the coupler-in-emulsion type having a non-diffusible group and contained in the photosensitive layer.

In the present invention, coupler-in-emulsion type development is preferred from the simplicity of development process.

As the coupler-in-emulsion type couplers for use in the present invention, 2-equivalent couplers substituted with a releasing group are preferred to 4-equivalent couplers which have a hydrogen atom at the active coupling position, since the coating amount of silver can be reduced.

Oil-protect type acylacetamide based couplers are representative as yellow couplers which can be used in the present invention. Specific examples thereof are disclosed in U.S. Pat. Nos. 2,407,210, 2,875,057 and 3,265,506. Two-equivalent yellow couplers are preferably used in the present invention. As 2-equivalent yellow couplers, oxygen atom-releasing type yellow couplers disclosed in U.S. Pat. Nos. 3,408,194, 3,447,928, 3,935,501 and 4,022,620, and nitrogen atom-releasing type yellow couplers disclosed in JP-B-58-10739, U.S. Pat. Nos. 4,401,752, 4,326,024, *RD*, No.18053 (April, 1979), British Patent 1,425,020, West German Patent Application (OLS) Nos. 2,219,917, 2,261, 361, 2,329,587 and 2,433,812 can be exemplified as representative examples. α-Pivaloylacetanilide based couplers are excellent in fastness of colored dye, in particular, light fastness, on the contrary, high color density can be obtained from α-benzoylacetanilide based couplers.

As magenta couplers which can be used in the present invention, oil-protect type pyrazoloazole based couplers such as 5-pyrazolone and pyrazolotriazole couplers can be exemplified. From the viewpoint of the hue of colored dye and color density, couplers substituted with an arylamino group or an acylamino group at the 3-position of 5-pyrazolone couplers are preferred, and representative examples thereof are disclosed in U.S. Pat. Nos. 2,311,082, 2,343,703, 2,600,788, 2,908,573, 3,062,653, 3,152,896 and 3,936,015. As a releasing group of 2-equivalent 5-pyrazolone based couplers, nitrogen atom-releasing groups disclosed in U.S. Pat. Nos. 4,310,619 and arylthio groups disclosed in U.S. Pat. No. 4,351,897 are preferred. Further, high color density can be obtained by 5-pyrazolone based couplers having a ballast group disclosed in European Patent 73636.

As pyrazoloazole based couplers, pyrazolobenzimidazoles disclosed in U.S. Pat. No. 3,369,879, preferably pyrazolo[5,1-c][1,2,4]triazoles disclosed in U.S. Pat. No. 3,725,067, pyrazolotetrazoles described in *Research Disclosure*, No. 24220 (June, 1984) and pyrazolopyrazoles described in *Research Disclosure*, No. 24230 (June, 1984) can be exemplified. In view of less side absorption of yellow of colored dye and light fastness, imidazo[1,2-b]pyrazoles disclosed in European Patent 119741 are preferred and pyrazolo[1,5-b][1,2,4]triazole disclosed in European Patent 119860 is particularly preferred.

Cyan couplers which can be used in the present invention include naphthol based couplers disclosed in U.S. Pat. Nos. 2,474,293, 4,052,212, 4,146,396, 4,228,233 and 4,296,200, phenol based cyan couplers having an alkyl group such as an ethyl group or more at the meta-position of the phenol nucleus disclosed in U.S. Pat. No. 3,772,002, phenol based cyan couplers substituted with a 2,5-diacylamino group disclosed in U.S. Pat. Nos. 2,772,162, 3,758,308, 4,126,396, 4,334,011, 4,327,173, West German Patent Application (OLS) 3,329,729, and JP-B-3-18175, and phenol based cyan couplers having a phenylureido group at the 2-position and an acylamino group at the 5-position disclosed in U.S. Pat. Nos. 3,446,622, 4,333,999, 4,451,559 and 4,427,767. Carbostyryl based couplers disclosed in JP-A-7-294714 are particularly excellent in heat resistance and light fastness and preferably used in the present invention.

Besides the above-described couplers, the following various couplers can be used in the present invention.

Representative examples of polymerized dye-forming couplers are disclosed in U.S. Pat. Nos. 3,451,820, 4,080, 211, 4,367,282, and British Patent 2,102,137.

Compounds which release photographically useful residual groups of compounds upon coupling reaction are also preferably used in the present invention. Development inhibitor-releasing DIR couplers as disclosed in the patents described in the above *RD*, No. 17643, item VII-F, JP-A-57-151944, JP-A-57-154234, JP-A-60-184248, and U.S. Pat. No. 4,248,962 are preferably used.

As couplers which imagewise release a nucleating agent or a development accelerator at development, those disclosed in British Patents 2,097,140, 2,131,188, JP-A-59-157638, and JP-A-59-170840 are preferred.

In addition, as the couplers which can be used in the photographic material of the present invention, there can be exemplified competitive couplers disclosed in U.S. Pat. No. 4,130,427, etc., multiequivalent couplers disclosed in U.S. Pat. Nos. 4,283,472, 4,338,393, 4,310,618, etc., DIR redox compound-releasing couplers disclosed in JP-A-60-185950, and couplers which release dyes the color of which is restored after elimination disclosed in EP-A-173302.

The above-described couplers for use in the present invention can be introduced into the photographic material by various well-known methods.

Examples of high boiling point solvents for use in an oil-in-water dispersing method are disclosed in U.S. Pat. No. 2,322,027. The amount of the high boiling point solvent is 10 g or less, preferably 5 g or less, and more preferably from 1 g to 0.1 g, per gram of the coupler. Further, to 1 g of the binder, the amount of the high boiling point solvent is 2 g or less, preferably 1 g or less, and more preferably 0.5 g or less. The size of the coupler dispersion (coupler emulsion) for use in a oil-in-water dispersing method is from 0.05 to 0.9 μm, preferably from 0.1 to 0.5 μm.

The process and effects of the latex dispersion method and specific examples of latexes for impregnation are disclosed in U.S. Pat. No. 4,199,363, German Patent Application (OLS) Nos. 2,541,274 and 2,541,230.

It is preferred for the photographic material according to the present invention to contain the dye image stability-improving compound as disclosed in EP-A-0277589 in the layer which contains a coupler. The combined use with apyrazoloazole magenta coupler is particularly preferred.

That is, the use of compound (F) which produces a chemically inactive and substantially colorless compound upon reaction with an aromatic amine developing agent remaining after color development and/or compound (G) which produces a chemically inactive and substantially colorless compound upon reaction with the oxidized product of an aromatic amine developing agent remaining after color development, alone or in combination, is preferred for preventing the generation of stain due to the formation of a colored dye caused by the coupling reaction of a coupler with the color developing agent or the oxidized product thereof remaining in the film, or preventing other side reactions, during preservation after processing.

As the dye image-forming compound for use in the photographic material according to the present invention, in addition to the above-described color couplers, non-diffusible dye-donating compounds which release diffusible dyes corresponding to or counter-corresponding to the reduction reaction of silver halide to silver can be exemplified. Specific examples of these dye-donating compounds are disclosed in JP-A-59-185333, JP-A-63-201653, EP-B-220746, U.S. Pat. Nos. 4,500,626, 4,639,408, 4,783,396, 4,232,107, 4,619,884, 4,450,223, 4,503,137, 4,559,209, etc.

In the present invention, the photographic material containing these dye-donating compounds is processed according to the methods disclosed in U.S. Pat. No. 3,923,510, German Patent (OLS) 2,916,582, JP-A-54-143230, and JP-A-7-43876.

The photographic material according to the present invention may be processed according to general wet processes comprising the steps of development by immersing a photographic material in a color developing solution containing a color developer maintained at 30 to 40° C., desilvering and washing processes as disclosed in *RD*, No. 17643, pp. 28 and 29 and ibid., No. 18716, p. 651, from left column to right column, otherwise the material may be processed by thermal development process of obtaining a color image on a photographic material or an image-receiving material by heating a photographic material and/or an image-receiving material containing a base precursor as disclosed in JP-A-1-161236, U.S. Pat. Nos. 4,483,914, 4,783,396, 4,500,626, 4,740,445, JP-A-8-339065, and JP-A-9-204031. Alternatively, the material may be development processed by the method in which a photosensitive sheet containing an image-receiving layer, a white reflective layer, a light-shielding layer, and at least one photosensitive silver halide emulsion layer combined with a dye image-forming compound provided on a transparent support, and a transparent cover sheet having a neutralization layer and a neutralization timing layer provided on a transparent support are superposed, an alkali processing composition is developed between both sheets by means of a pressure roller. Further, thermal developing dry process of incorporating organic silver salts such as silver carbonate and silver acetylide into a photographic material and forming an image only with heating as disclosed in JP-A-64-13546, JP-A-9-106820 and U.S. Pat. No. 4,460,681 may also be used.

The photographic material and development process according to the present invention are described in detail in James, *The Theory of the Photographic Process,* 4th Ed., pp. 353 to 372 (1977), Van de Sande, *Dye Diffusion System in Color Photography*, Angewandte Chemie International Edition 22 (1983), pp. 191 to 209, *Imaging Systems*, Jacobson & Jacobson, Focal Press (1976) pp. 86 to 103, and Nihon Shashin Gakkai compiled, *Revised Shashin Kogaku no Kiso, Gin-en Shashin Hen* (*Basis of Photographic Technology, Silver Salt Photography*), Corona Co., Ltd. (1998).

The photographic material according to the present invention comprises at least three silver halide emulsion layers and, if necessary, various auxiliary layers such as a protective layer, an undercoat layer, an interlayer, a yellow filter layer, an antihalation layer, and a backing layer may be provided. A subbing layer and a protective layer may be further added to the backing layer. Further, each photosensitive layer maybe divided to two or more layers. Each of these layers may contain a hydroquinone derivative, an aminophenol derivative, a gallic acid derivative, an ascorbic acid derivative, etc., as the color fog preventing agent or the discoloration inhibitor. The above-described ultraviolet absorbers may be contained for preventing deterioration due to light.

When the support is polyethylene laminated paper containing a white pigment such as titanium oxide, the backing layer is preferably designed to have an antistatic function and surface resistivity of $10^{12}$ Ω·cm or less.

In the next place, the organic light emitting device for use in the present invention will be described.

In the present invention, exposure of the photographic material is performed with at least three, or four, if necessary, independent dot array state organic light emitting devices each having peak wavelength of emission spectrum within the wavelength region corresponding to the spectral sensitivity of each photosensitive layer of the photographic material, in a manner that the emission strengths of emission spectra of the organic light emitting devices gradually increase from the organic light emitting device emitting light at the shortest wavelength region to the organic light emitting device emitting light at the longest wavelength region. The peak wavelength of the emitting spectrum of the organic light emitting device preferably coincides with the wavelength of the corresponding photosensitive layer giving the maximum spectral sensitivity, but the peak wavelength may be on the short wavelength side within 50 nm, preferably within 30 nm, from the wavelength giving the maximum spectral sensitivity.

Luminescence can be obtained by applying direct current (if necessary, alternating current component may be contained) voltage (generally pulse voltage of from 2 to 30 V) or pulse current between the anode and the cathode. In the present invention, the exposure time per one pixel is from 1 to $10^{-7}$ seconds, preferably from $10^{-1}$ to $10^{-6}$ seconds, taking the writing time of one picture plane into consideration. Methods disclosed in JP-A-2-148687, JP-A-6-301355, JP-A-5-29080, JP-A-7-134558, JP-A-8-234685 and JP-A-8-241047 can be utilized for driving the organic light emitting device of the present invention.

In the present invention, the exposure amount control of the organic light emitting device may be effected by an intensity modulation system or a time modulation system. According to an intensity modulation system, the exposure amount can be adjusted by controlling the emitting strength of the device by controlling the electric current applied to the device. According to a time modulation system, the exposure amount can be adjusted by varying the irradiation time with maintaining the strength of emission of the device constant. Further, a pulse modulation system in which light is emitted by pulse and controls the exposure amount by pulse count of light irradiation can be adopted.

In the present invention, the organic light emitting devices are used as dot arrays provided by being classified as luminescent colors. Each luminescent color may be one line or a plurality of lines. The size of one pixel is from 10 to 500 μm, preferably from 50 to 300 μm.

Each dot of dot array state organic light emitting device of each luminescent color emits light in at least eight scattered levels and exposure of the photosensitive layer is performed correspondingly in at least eight scattered levels (eight gradations). Preferably, each dot emits light in at least 64 scattered levels and exposure of the photosensitive layer is performed correspondingly in at least 64 scattered levels (64 gradations). More preferably, each dot emits light in at least 256 scattered levels and exposure of the photosensitive layer is performed correspondingly in at least 256 scattered levels (256 gradations)

As the material of the anode for use in the organic light emitting device according to the present invention, a transparent electrode such as a tin oxide, an indium tin oxide (ITO), an indium zinc oxide, etc., is provided on a transparent substrate, and the cathode such as Mg—Ag, Al, Li—Al, Ca, etc., is provided thereon, or the above cathode is provided on the substrate (in this case, it is not necessarily transparent), and at least one organic compound layer including the luminescent layer (the layer thickness is preferably from 10 nm to 1 μm in total of the organic compound layer) is provided thereon, and the above transparent electrode may further be provided thereon. In the latter case, composite materials containing glass fibers and ceramics which are used as general electric circuit substrates may be used.

In the organic light emitting device according to the present invention, at least one organic compound layer including the luminescent layer is provided on the anode or cathode. Specific constitutions of the devices containing the organic compound layer include anode/hole transporting layer/luminescent layer/cathode, anode/luminescent layer/electron transporting layer/cathode, anode/hole transporting layer/luminescent layer/electron transporting layer/cathode, anode/luminescent layer/cathode (the constitution may be reverse). A plurality of luminescent layers, hole transporting layers and electron transporting layers may be provided, or a hole injecting layer and an electron injecting layer may be provided.

In addition to these constitutions, it is preferred to provide an electroconductive polymer layer between the anode and the hole transporting layer (if the hole transporting layer is not provided, the luminescent layer) in contact with the anode. By the provision of this conductive polymer layer, the layer thickness of the organic compound layer can be increased with hardly increasing the driving voltage, as a result irregular luminance and short-circuits can be improved. As the electroconductive polymer, polyaniline derivatives, polythiophene derivatives and polypyrrole derivatives disclosed in WO 98/05187, etc., can be preferably used. These derivatives can be mixed with protonic acids (e.g., camphorsulfonic acid, p-toluenesulfonic acid, styrenesulfonic acid, polystyrenesulfonic acid). Further, polyaniline derivatives may be used in mixture of Leucoemeraldine, Emeraldine, and Pernigraniline alone or mixture of two or more. These derivatives may be mixed, if necessary, with other high molecular weight compounds (e.g., polymethyl methacrylate (PMMA), poly-N-vinylcarbazole (PVCz)). The surface resistivity of the electrically conductive polymer layer is preferably 10,000 Ω□ or less. The thickness of the conductive polymer layer is from 10 to 1,000 nm, particularly preferably from 20 to 200 nm.

The luminescent layer for use in the present invention may be an electron transportable luminescent layer or a hole transportable luminescent layer. The luminescent layer contains at least one luminescent material. The luminescent material is not particularly restricted and any material can be used so long as it can emit fluorescence by excitation, e.g., an oxynoide compound, a perylene compound, a coumarin compound, an azacoumarin compound, an oxazole compound, an oxadiazole compound, a perinone compound, a pyrrolopyrrole compound, a naphthalene compound, an anthracene compound, a fluorenone compound, a fluoranthene coompound, a tetracene compound, a pyrene compound, a coronene compound, a quinolone compound, an azaquinolone compound, a pyrazoline derivative, a pyrazolone derivative, a rhodamine compound, a chrysene compound, a phenanthrene compound, a cyclopentadiene compound, a stilbene compound, a diphenylquinone compound, a styryl compound, a distyrylbenzene compound, a butadiene compound, a dicyanomethylenepyran compound, a dicyanomethylenethiopyran compound, a fluorescein compound, a pyrylium compound, a thiapyrylium compound, a selenapyrylium compound, a telluropyrylium compound, an aromatic aldaziene compound, an oligophenylene compound, a xanthene compound, a thioxanthene compound, a cyanine compound, an acridine compound, an acridone compound, a quinoline compound, a metal complex of 8-hydroxyquinoline compound, benzoquinolylberyllium complex, a metal complex of 2,2'-bipyridine compound, a complex of Schiff base and group III metal, a metal complex of oxadiazole compound, and a rare earth complex can be used.

These luminescent materials may be used alone or in combination of two or more. Luminescent materials may be used by being dispersed in a carrier transportable polymer, or a low molecular weight carrier transporting agent and a luminescent material may be molecular dispersed in a polymer not having carrier transportability.

The electron transportable polymer means a polymer having an electron-accepting group at the side chain or main chain, the hole transportable polymer means a polymer having an electron-donating group at the side chain or main chain, and the polymer not having carrier transportability means an electrically inactive polymer such as polymethyl methacrylate, polymethyl acrylate, polystyrene, and polycarbonate. The low molecular weight carrier transporting agent used in the case where the polymer does not have transportability means an electron transporting low molecular weight material (an electron-acceptor) or a hole transporting low molecular weight material (an electron-donor).

Polymer luminescent materials are also preferably used. Examples of polymer luminescent materials include π conjugated system such as a poly-p-phenylenevinylene derivative, a polyfluorene derivative, and a polythiophene derivative, and polymers which introduced a low molecular weight dye and tetraphenyldiamine or triphenylamine into the main chain and side chain. A polymer luminescent material and a low molecular weight luminescent material may be mixed.

As the electron transportable compounds, an oxadiazole derivative, a triazole derivative, a triazine derivative, a nitro-substituted fluorenone derivative, a thiopyran dioxide derivative, a diphenylquinone derivative, a perylenetetracarboxyl derivative, an anthraquinodimethane derivative, a fluorenylidene derivative, an anthrone derivative, a perynone derivative, an oxine derivative, and a quinoline complex derivative can be exemplified.

As hole transportable compounds, poly-N-vinylcarbazole, a polyphenylene vinylene derivative, polymer compounds such as polyphenylene, polythiophene, polymethylphenylsilane, and polyaniline, a triazole derivative, an oxadiazole derivative, an imidazole derivative, a polyarylalkane derivative, a pyrazoline derivative, a pyrazolone derivative, a phenylenediamine derivative, an arylamine derivative, an amino-substituted chalcone derivative, an oxazole derivative, a carbazole derivative, a styrylanthracene derivative, a fluorenone derivative, a hydrazone derivative, a stilbene derivative, a porphyrin derivative such as phthalocyanine, an aromatic tertiary amine compound, a styrylamine compound, a butadiene compound, a benzidine derivative, a polystyrene derivative, a triphenylmethane derivative, a tetraphenylbenzine derivative, and a starburst-polyamine derivative can be exemplified.

The organic compound layers such as the hole transporting layer, the electron transporting layer, the luminescent layer and the electroconductive polymer layer can be formed by various well-known process, e.g., a vacuum deposition process, a sputtering process, a dipping process, a spin coating process, a casting process, a bar coat process, and a roll coat process. By using several solvents each in its proper way, multilayer coating is also feasible.

The above-described cathode is provided on the electron transporting layer. Further, the cathode may be provided with a thin layer of aluminum oxide or lithium fluoride having a thickness of from 0.01 to 10 nm or so between.

A protective layer may be provided on the surface of the cathode (opposite side to the organic compound layer) to exclude moisture and air. The protective layer for this purpose is disclosed in JP-A-7-85974. Further, the device is preferably sealed with glass and poly (chlorotrifluoroethylene) sheet. A desiccant and a repellent fluorine-based inactive liquid may be put therein.

In the present invention, besides ordinary glass substrates, a plastic substrate may be used as a transparent substrate. The plastic substrate must be excellent in heat resistance, dimensional stability, solvent resistance, electrical insulating property, processability, low permeability, and hygroscopicity. As such materials, polyethylene terephthalate, polybutylene terephthalate, polyethylene naphthalate, polystyrene, polycarbonate, polyether sulfone, polyallylate, allyl diglycol carbonate, and polyimide can be exemplified. It is preferred to provide a moisture permeation preventing layer (a gas barrier layer) on the surface of the substrate or on the opposite side to the electrode (back surface). As the moisture permeation preventing layer (a gas barrier layer), inorganic substances such as silicon nitride and silicon oxide are preferably used, and the layer can be formed, e.g., by a high frequency sputtering method. Further, if necessary, a hard coat layer and an undercoat layer may be provided.

Patterning of the electrode (in particular, the transparent electrode) can be performed by chemical etching such as photolithography, or physical etching using a laser beam is also applicable. Vacuum deposition and sputtering may be performed on the superposed mask.

EXAMPLE

The present invention is specifically described below with referring to examples, but it should not be construed as the present invention is limited thereto.

Example 1

Preparation of Color Photographic Material

Preparation of Photosensitive Silver Halide Emulsion

Photosensitive Silver Halide Emulsion (1) (for Red-sensitive Emulsion Layer)

Solution (I) and Solution (II) each having the composition shown in Table 1 were simultaneously added over 19 minutes at a constant flow rate to an aqueous gelatin solution with thoroughly stirring (800 g of gelatin, 12 g of sodium bromide, 80 g of sodium chloride, and 1.2 g of Compound (a) were added to 27 liters of water and maintained the temperature at 55° C.). After 5 minutes, Solution (III) and Solution (IV) each having the composition shown in Table 1 were simultaneously added over 24 minutes at a constant flow rate.

The reaction solution was washed with water by ordinary method and desalted, 880 g of lime-processed ossein gelatin and 2.8 g of Compound (b) were added and pH was adjusted to 6.2, pAg was adjusted to 7.7, then 20.5 g of ribonucleic acid decomposed product and 51 mg of trimethylthiourea were added to the solution and the solution was optimally chemically sensitized at 60° C. for about 70 minutes. Thereafter, 9.0 g of 4-hydroxy-6-methyl-1,3,3a,7-tetraazaindene, 3.2 g of Dye (a), and20.5 g of KBr were in order, and the reaction solution was cooled. Thus, 29.5 kg of a monodispersed cubic silver chlorobromide emulsion having an average grain size of 0.30 $\mu$m was obtained.

TABLE 1

| | Solution I | Solution II | Solution III | Solution IV |
|---|---|---|---|---|
| $AgNO_3$ | 1,200 g | — | 2,800 g | — |
| $NH_4NO_3$ | 2.5 g | — | 2.5 g | — |
| KBr | — | 546 g | — | 1,766 g |
| NaCl | — | 144 g | — | 96 g |
| $K_2IrCl_6$ | — | 3.6 mg | — | — |
| Water to make | 6.5 liters | 6.5 liters | 10 liters | 10 liters |

Compound a

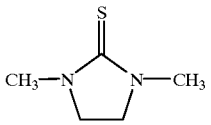

-continued

Compound b

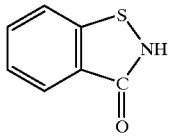

Dye (a)

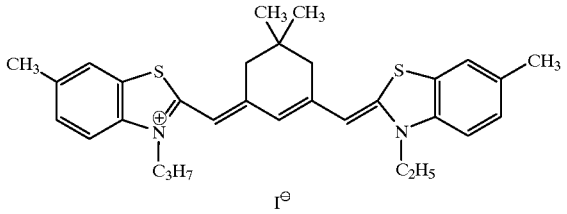

Photosensitive Silver Halide Emulsion (2) (for Green-sensitive Emulsion Layer)

Solution (I) and Solution (II) each having the composition shown in Table 2 were simultaneously added over 10 minutes at a constant flow rate to an aqueous gelatin solution with thoroughly stirring (20 g of gelatin, 0.3 g of potassium bromide, 2 g of sodium chloride, and 30 mg of Compound (a) were added to 600 ml of water and maintained the temperature at 46° C.). After 5 minutes, Solution (III) and Solution (IV) each having the composition shown in Table 2 were simultaneously added over 30 minutes at a constant flowrate. One minute after the termination of the addition of Solutions (III) and (IV), 60 ml of a methanol solution of a dye (containing 360 mg of Dye (b1) and 73.4 mg of Dye (b2)) was added thereto.

After the reaction solution was washed with water by ordinary method and desalted (Precipitant (a) was used, pH was 4.0), 22 g of lime-processed ossein gelatin, NaCl and NaOH each in an appropriate amount were added to the reaction solution to adjust pH to 6.0 and pAg to 7.6, then 1.8 mg of sodium thiosulfate and 180 mg of 4-hydroxy-6-methyl-1,3,3a,7-tetraazaindene were added and the reaction solution was optimally chemically sensitized at 60° C. Thereafter, 90 mg of Antifoggant (1) was added and the reaction solution was cooled. Compound (b) (70 mg) and Compound (c) (3 ml) were added to the solution as antiseptics. Thus, 635 g of a monodispersed cubic silver chlorobromide emulsion having an average grain size of 0.30 $\mu$m was obtained.

TABLE 2

| | Solution I | Solution II | Solution III | Solution IV |
|---|---|---|---|---|
| $AgNO_3$ | 10.0 g | — | 90.0 g | — |
| $NH_4NO_3$ | 0.06g | — | 0.38g | — |
| KBr | — | 3.50g | — | 57.1 g |
| NaCl | — | 1.72g | — | 3.13 g |
| $K_2IrCl_6$ | — | — | — | 0.03mg |
| Water to make | 126 ml | 131 ml | 280 ml | 289 ml |

Sensitizing Dye (b1)

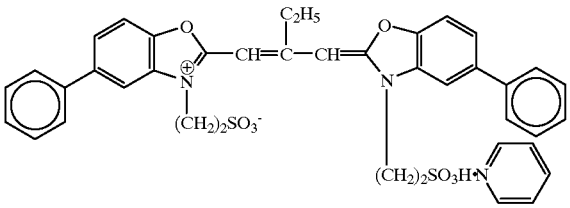

Sensitizing Dye (b2)

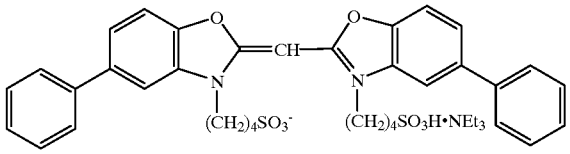

Precipitant (a)

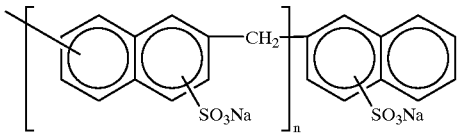

Antifoggant (1)

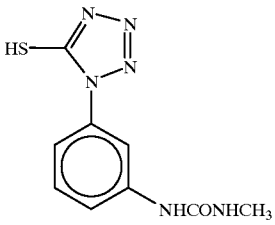

Compound (c)

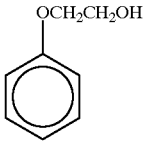

Photosensitive Silver Halide Emulsion (3) (for Blue-sensitive Emulsion Layer)

Solution (II) having the composition shown in Table 3 was added over 30 minutes to an aqueous gelatin solution with thoroughly stirring (1,582 g of gelatin, 127 g of KBr, and 660 mg of Compound (a) were added to 29.2 liters of water and maintained the temperature at 70° C.), and Solution (I) was added 10 seconds after the start of the addition of Solution (II) over 30 minutes. Five minutes after the termination of the addition of Solution (II), Solution (IV) was started to be added over 28 minutes, and 10 seconds after the start of the addition of Solution (IV), Solution (III) was added over 27 minutes and 50 seconds.

After the reaction solution was washed with water by ordinary method and desalted (Precipitant (b) was used, pH was 3.9), 1,230 g of lime-processed ossein gelatin and 2.8 g of Compound (b) were added to adjust pH to 6.1 and pAg to 8.5. Subsequently, 27.7 mg of sodium thiosulfate was added thereto and chemical sensitization was performed optimally at 65° C. for about 70 minutes. Then, 17.5 g of Dye (c), 2.8 g of Antifoggant (1), and 117 ml of Compound (c) were added in order and the reaction solution was cooled. The silver halide grains of the thus-obtained emulsion were octahedral and grain size was 0.55 μm, and the yield was 29.1 kg.

TABLE 3

| | Solution I | Solution II | Solution III | Solution IV |
|---|---|---|---|---|
| $AgNO_3$ | 792 g | — | 3,608 g | — |
| $NH_4NO_3$ | 3.4 g | — | 15.4 g | — |
| KBr | — | 572 g | — | 2,608 g |
| Water to make | 6.69 liters | 6.68 liters | 9.70 liters | 9.74 liters |

Precipitant (b)

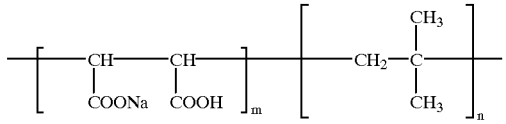

$_{m+n=1}$

Dye (c)

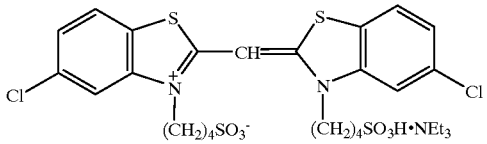

The producing method of a gelatin dispersion of Compound (d) is described below.

Compound (d) (0.4 g), 1.1 g of High Boiling Point Organic Solvent (1), 0.1 g of Compound (f), 0.2 g of Compound (g) and 0.2 g of Surfactant (1) were weighed, and 9.5 ml of ethyl acetate was added thereto, and the reaction system was dissolved by heating at about 60° C., thereby a homogeneous solution was obtained. This solution and 60 g of a 16% solution of lime-processed gelatin were mixed and stirred, and then dispersed with a homogenizer at 10,000 rpm for 10 minutes. After being dispersed, 29 ml of water for dilution was added thereto, and the obtained dispersion solution was designated Compound Dispersion (d).

Compound (d)

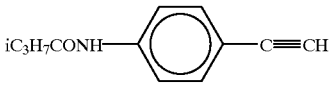

High Boiling Point Organic Solvent (1)

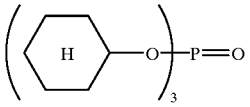

Compound (f)

$C_{26}H_{46.9}Cl_{7.1}$

Compound (g)

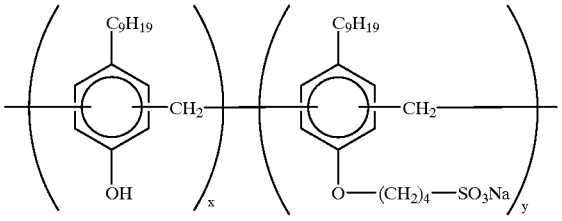

$_{x/y=58/42}$

-continued

Surfactant (1)

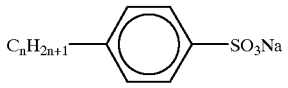

$_n$=12.6

The producing method of a zinc hydroxide dispersion is described below.

Zinc hydroxide (12.5 g) having an average particle size of 0.2 $\mu$m, 1 g of carboxymethyl cellulose as a dispersant, and 0.1 g of sodium polyacrylate were added to 100 ml of a 4% aqueous gelatin solution, and the mixture was pulverized in a mill with glass beads having an average diameter of 0.75 mm for 30 minutes. Glass beads were removed, thereby a zinc hydroxide dispersion was obtained.

The producing method of a gelatin dispersion of a dye-donating compound is described below.

Cyan Dye-Donating Compound (A1) (7.3 g), 11.0 g of Cyan Dye-Donating Compound (A2), 0.8 g of Surfactant (1), 1 g of Compound (h), 1.3 g of Compound (i), 4.4 g of Compound (j), 2.2 g of Compound (k), 7 g of High Boiling Point Organic Solvent (1), and 3 g of High Boiling Point Organic Solvent (2) were weighed, and 26 ml of ethyl acetate was added thereto, and the reaction system was dissolved by heating at about 60° C., thereby a homogeneous solution was obtained. This solution and 65 g of a 16% solution of lime-processed gelatin and 87 ml of water were mixed and stirred, and then dispersed with a homogenizer at 10,000 rpm for 10 minutes. After being dispersed, 220 ml of water for dilution was added thereto, and the obtained dispersion solution was designated Cyan Dye-Donating Compound Dispersion.

Cyan Dye-Donating Compound (A1)

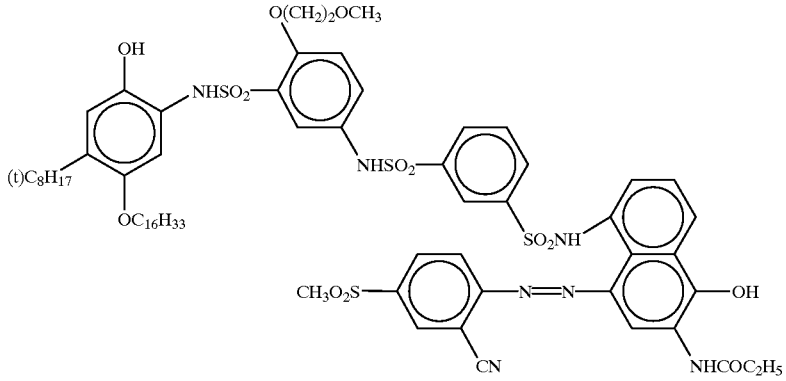

Cyan Dye-Donating Compound (A2)

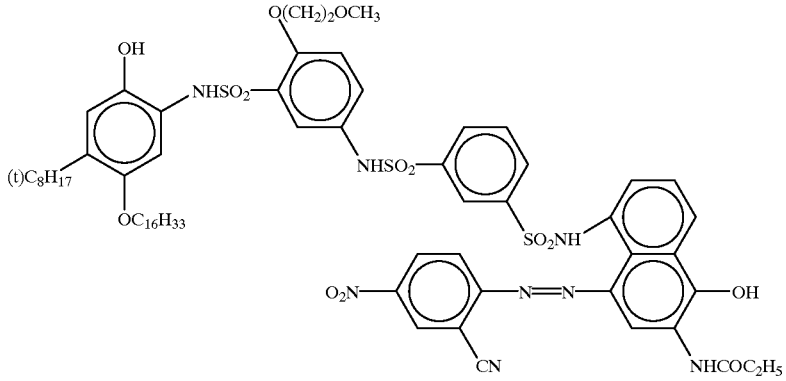

Compound (h)

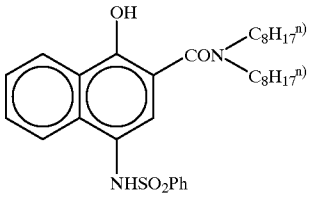

Compound (i)

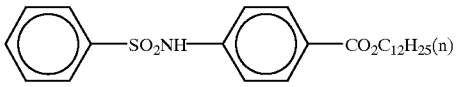

-continued

Compound (j)

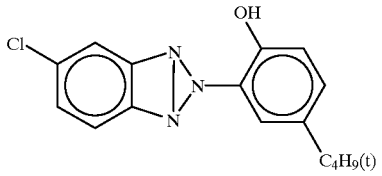

Compound (k)

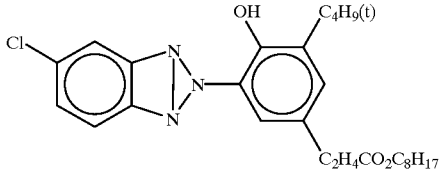

High Boiling Point Organic Solvent (2)

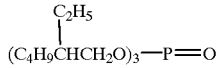

Magenta Dye-Donating Compound (B) (4.50 g), 0.05 g of Compound (m), 0.05 g of Compound (h), 0.094 g of Surfactant (1), 2.25 g of High Boiling Point Organic Solvent (2) were weighed, and 10 ml of ethyl acetate was added thereto, and the reaction system was dissolved by heating at about 60° C., thereby a homogeneous solution was obtained. This solution and 15.2 g of a 16% solution of lime-processed gelatin and 23.5 ml of water were mixed and stirred, and then dispersed with a homogenizer at 10,000 rpm for 10 minutes. After being dispersed, 42 ml of water for dilution was added thereto, and the obtained dispersion solution was designated Magenta Dye-Donating Compound Dispersion.

Magenta Dye-Donating Compound (B)

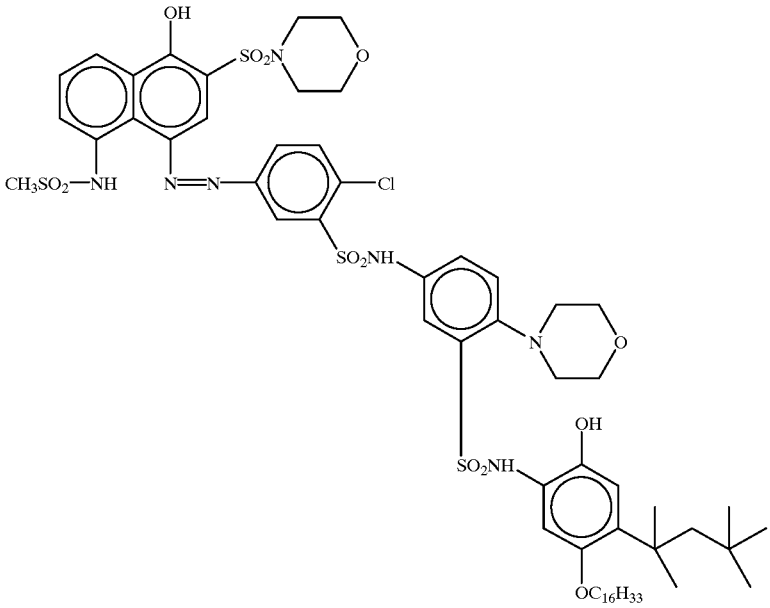

Compound (m)

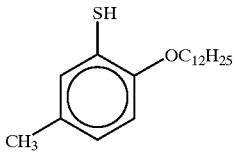

Yellow Dye-Donating Compound (C) (15 g), 3 g of Compound (d), 1.5 g of Compound (h), 1.4 g of Surfactant (1), 7.5 g of High Boiling Point Organic Solvent (2) were weighed, and 40 ml of ethyl acetate was added thereto, and the reaction system was dissolved by heating at about 60° C., thereby a homogeneous solution was obtained. This solution and 53 g of a 16% solution of lime-processed gelatin and 85.7 ml of water were mixed and stirred, and then dispersed with a homogenizer at 10,000 rpm for 10 minutes. After being dispersed, 83.7 ml of water for dilution was added thereto, and the obtained dispersion solution was designated Yellow Dye-Donating Compound Dispersion.

Yellow Dye-Donating Compound (C)

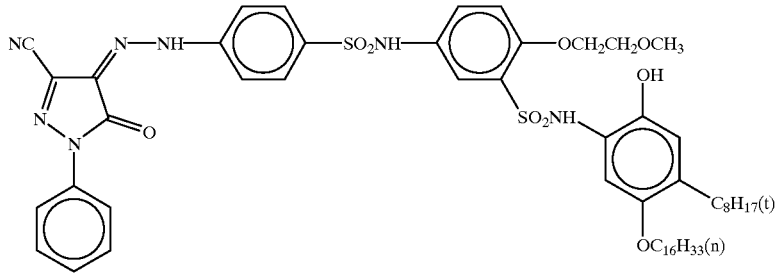

Photographic Material 101 as shown in Tables 4, 5, and 6 was prepared.

TABLE 4

| Constitution of Photographic Material No. 101 | Coating Amount ($g/m^2$) |
|---|---|
| Seventh Layer (protective layer) | |
| Acid-Processed Gelatin | 0.424 |
| PMMA Matting Agent | 0.11 |
| Surfactant (2) | 0.0053 |
| Surfactant (3) | 0.016 |
| Sixth Layer (interlayer) | |
| Gelatin | 0.511 |
| Zn(OH)2 | 0.336 |
| Surfactant (3) | 0.0011 |
| Compound (d) | 0.027 |
| Compound (f) | 0.0068 |
| Compound (g) | 0.0135 |
| High Boiling Point Organic Solvent (1) | 0.081 |
| Ca $(NO_3)_2$ | 0.008 |
| Water-Soluble Polymer (1) | 0.0038 |
| Fifth Layer (blue-sensitive layer) | |
| Silver Halide Emulsion (3) | as silver0.32 |
| Gelatin | 0.37 |
| Yellow Dye-Donating Compound (C) | 0.37 |
| Compound (d) | 0.074 |
| Compound (h) | 0.037 |
| High Boiling Point organic Solvent (2) | 0.19 |
| Surfactant (1) | 0.035 |
| Water-Soluble Polymer (1) | 0.002 |
| Fourth Layer (interlayer) | |
| Gelatin | 0.436 |
| Zn $(OH)_2$ | 0.286 |
| Surfactant (3) | 0.001 |
| Compound (d) | 0.023 |
| Compound (f) | 0.0058 |

TABLE 4-continued

| Constitution of Photographic Material No. 101 | Coating Amount ($g/m^2$) |
|---|---|
| Compound (g) | 0.0115 |
| High Boiling Point Organic Solvent (1) | 0.069 |
| Ca $(NO_3)_2$ | 0.007 |

TABLE 4-continued

| Constitution of Photographic Material No. 101 | Coating Amount ($g/m^2$) |
|---|---|
| Water-Soluble Polymer (1) | 0.0032 |

TABLE 5

(cont'd from Table 4)

| | Coating Amount ($g/m^2$) |
|---|---|
| Third Layer (green-sensitive layer) | |
| Silver Halide Ernulsion (2) | as silver0.34 |
| Gelatin | 0.425 |
| Magenta Dye-Donating Compound (B) | 0.431 |
| Compound (m) | 0.005 |
| Compound (h) | 0.005 |
| High Boiling Point Organic Solvent (2) | 0.324 |
| Surfactant (1) | 0.009 |
| Water-Soluble Polymer (1) | 0.010 |
| Second Layer (interlayer) | |
| Gelatin | 0.443 |
| Surfactant (4) | 0.013 |
| Surfactant (3) | 0.006 |
| Compound (d) | 0.025 |
| Compound (f) | 0.0063 |
| Compound (g) | 0.0125 |
| High Boiling Point Organic Solvent (1) | 0.073 |
| Ca $(NO_3)_2$ | 0.008 |
| Water-Soluble Polymer (1) | 0.008 |
| First Layer (red-sensitive layer) | |
| Silver Halide Emulsion (1) | as silver0.19 |

TABLE 5-continued (cont'd from Table 4)

| | Coating Amount ($g/m^2$) |
|---|---|
| Gelatin | 0.27 |
| Cyan Dye-Donating Compound (A1) | 0.120 |
| Cyan Dye-Donating Compound (A2) | 0.180 |
| Compound (i) | 0.021 |
| Compound (h) | 0.016 |
| Compound (j) | 0.072 |
| Compound (k) | 0.036 |
| High Boiling Point Organic Solvent (1) | 0.108 |
| High Boiling Point organic Solvent (2) | 0.046 |
| Surfactant (1) | 0.012 |
| Water-Soluble Polymer (1) | 0.010 |
| Stabilizer | 0.004 |
| Hardening Agent | 0.045 |
| Support (1) | |
| Polyethylene laminated paper support, thickness: 131 μm | |

TABLE 6

(cont'd from Table 5)
Constitution of Support (1)

| Layer Name | Composition | | Layer Thickness (μm) |
|---|---|---|---|
| Surface Undercoat Layer | Gelatin | | 0.1 |
| Surface PE Layer (glossy) | Low density polyethylene (density: 0.923): | 89.2 parts | 36.0 |
| | Surface-treated titanium oxide: | 10.0 parts | |
| | Ultramarine: | 0.8 part | |
| Pulp Layer | High quality paper (LBKP/NBKP = 1/1, density: 1.080) | | 64.0 |
| Back PE Layer (mat) | High density polyethylene (density: 0.960) | | 31.0 |
| Back Undercoat Layer | Gelatin | | 0.05 |
| | Colloidal silica | | 0.05 |
| | Total | | 131.2 |

Surfactant (2)

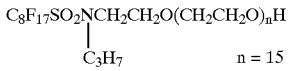

$C_8F_{17}SO_2N(C_3H_7)CH_2CH_2O(CH_2CH_2O)_nH$ n = 15

Surfactant (3)

Aerosol OT

Surfactant (4)

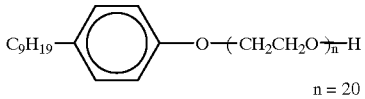

$C_9H_{19}$—C$_6$H$_4$—O—$(CH_2CH_2O)_n$—H n = 20

TABLE 6-continued (cont'd from Table 5)
Constitution of Support (1)

Water-Soluble Polymer (1)

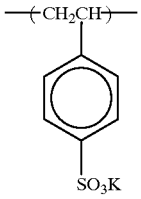

Hardening Agent $CH_2{=}CHSO_2CH_2SO_2CH{=}CH_2$

Stabilizer

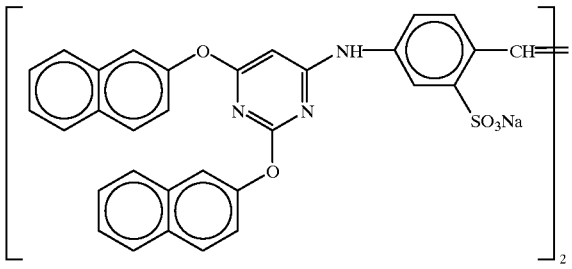

Image-receiving material R201 as shown in Tables 7, 8 and 9 was prepared.

TABLE 7

Constitution of Image-Receiving Material R201

| | Coating Amount ($mg/m^2$) |
|---|---|
| Fourth Layer | |
| Carrageenan | 60 |
| Water-Soluole Polymer (2) | 240 |
| Potassium Nitrate | 50 |
| Surfactant (6) | 7 |
| Surfactant (2) | 5 |
| Third Layer | |
| Gelatin | 250 |
| Water-Soluble Polymer (2) | 10 |
| Surfactant (5) | 27 |
| Hardening Agent (2) | 170 |
| Second Layer | |
| Gelatin | 800 |
| High Boiling Point organic Solvent (3) | 650 |
| Brightening Agent (1) | 22 |
| Compound (P) | 32 |
| Surfactant (3) | 10 |
| Mordant (1) | 2,350 |
| Polymer Dispersion | 1,190 |
| Dextran | 660 |
| Water-Soluble Polymer (2) | 100 |
| Guanidine Picolinate | 2,900 |

TABLE 8

(cont'd from Table 7)

| First Layer | |
|---|---|
| Gelatin | 150 |
| Water-Soluble Polymer (2) | 40 |
| Surfactant (3) | 6 |
| Surfactant (5) | 27 |
| Hardening Agent (2) | 170 |
| Support (2) | |
| Polyethylene laminated paper support, thickness: 206 μm | |

TABLE 9

(cont'd from Table 8)
Constitution of Support (2)

| Layer Name | Composition | | Layer Thickness (μm) |
|---|---|---|---|
| Surface Undercoat Layer | Gelatin | | 0.1 |
| Surface PE Layer (glossy) | Low density polyethylene (density: 0.923): | 89.2 parts | 35.0 |
| | Surface-treated titanium oxide: | 10.0 parts | |
| | Ultramarine: | 0.8 part | |
| Pulp Layer | High quality paper (LBKP/NBKP = 1/1, density: 1.080) | | 140.8 |
| Back PE Layer (mat) | High density polyethylene (density: 0.960) | | 30.0 |
| Back Undercoat Layer | Gelatin | | 0.05 |
| | Colloidal silica | 0.05 | |
| | | Total | 206.0 |

Water-Soluble Polymer (2)

Sumikagel L5-H (manufactured by Sumitomo Chemical Co., Ltd.)

Polymer Dispersion

Nipol LX814 (manufactured by Nippon Zeon Co., Ltd.)

Surfactant (5)

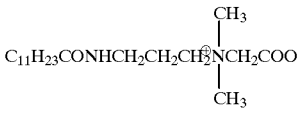

Surfactant (6)

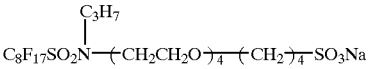

High Boiling Point Solvent (3)

$C_{26}H_{46.9}Cl_{7.1}$

Brightening Agent (1)

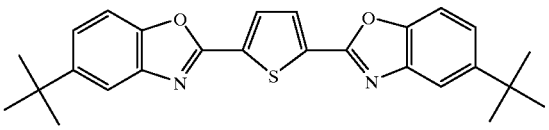

-continued

Compound (P)

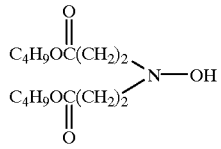

Mordant (1)

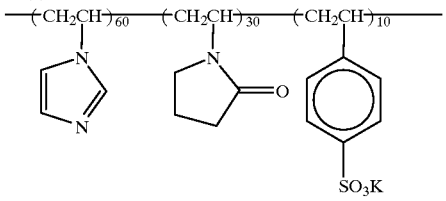

Hardening Agent (2)

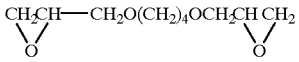

The above Photographic Material No. 101 was exposed using a wedge spectral sensitivity meter described in the above T. H. James, *The Theory of the Photographic Process,* 4th Ed., p. 512. Fountain solution was supplied to the emulsion surface of the exposed photographic material by means of a wire bar and superposed with image-receiving material R201 so as to get in contact with the film surface. The photographic material was heated at development temperature of 83° C. for 30 seconds, the image-receiving material was peeled from the photographic material, thereby an image showing the spectral sensitivity was obtained on the image-receiving material. The spectral sensitivity curve obtained are shown in FIG. 1.

Comparative photographic material No. 102 was prepared in the following manner and exposure by the wedge spectral sensitivity meter and thermal development were performed in the same manner as in Photographic Material No. 101 and spectral sensitivity was measured.

Comparative photographic material No. 102 was prepared in the same manner as the preparation of Photographic Material No. 101 except that photosensitive silver halide emulsion (2) was replaced with the following prepared photosensitive silver halide emulsion (4) for a green-sensitive layer.

Preparation of Photosensitive Silver Halide Emulsion (4)

Solution (I) and Solution (II) each having the composition shown in Table 2 were simultaneously added over 10 minutes at a constant flow rate to an aqueous gelatin solution with thoroughly stirring (20 g of gelatin, 0.5 g of potassium bromide, 1.5 g of sodium chloride, and 25 mg of Compound (a) were added to 600 ml of water and maintained the temperature at 36° C.). After 5 minutes, Solution (III) and Solution (IV) each having the composition shown in Table 2 were simultaneously added over 30 minutes at a constant flow rate. One minute after the termination of the addition of Solutions (III) and (IV), a methanol solution of a dye (containing 420 mg of Dye (b1) and 85.6 mg of Dye (b2)) was added thereto.

After the reaction solution was washed with water by ordinary method and desalted (Precipitant (a) was used, pH was 4.0), 22 g of lime-processed ossein gelatin, NaCl and NaOH each in an appropriate amount were added to the reaction solution to adjust pH to 6.2 and pAg to 7.8, then 2.4 mg of sodium thiosulfate and 180 mg of 4-hydroxy-6-methyl-1,3,3a,7-tetraazaindene were added and the reaction solution was optimally chemically sensitized at 60° C.

Thereafter, 70 mg of Antifoggant (1) was added and the reaction solution was cooled. Compound (b) (70 mg) and Compound (c) (3 ml) were added to the solution as antiseptics. Thus, 630 g of a monodispersed cubic silver chlorobromide emulsion having an average grain size of 0.12 μm was obtained. Table 2 is the same as the Photosensitive Silver Halide Emulsion (2).

Figure 2:
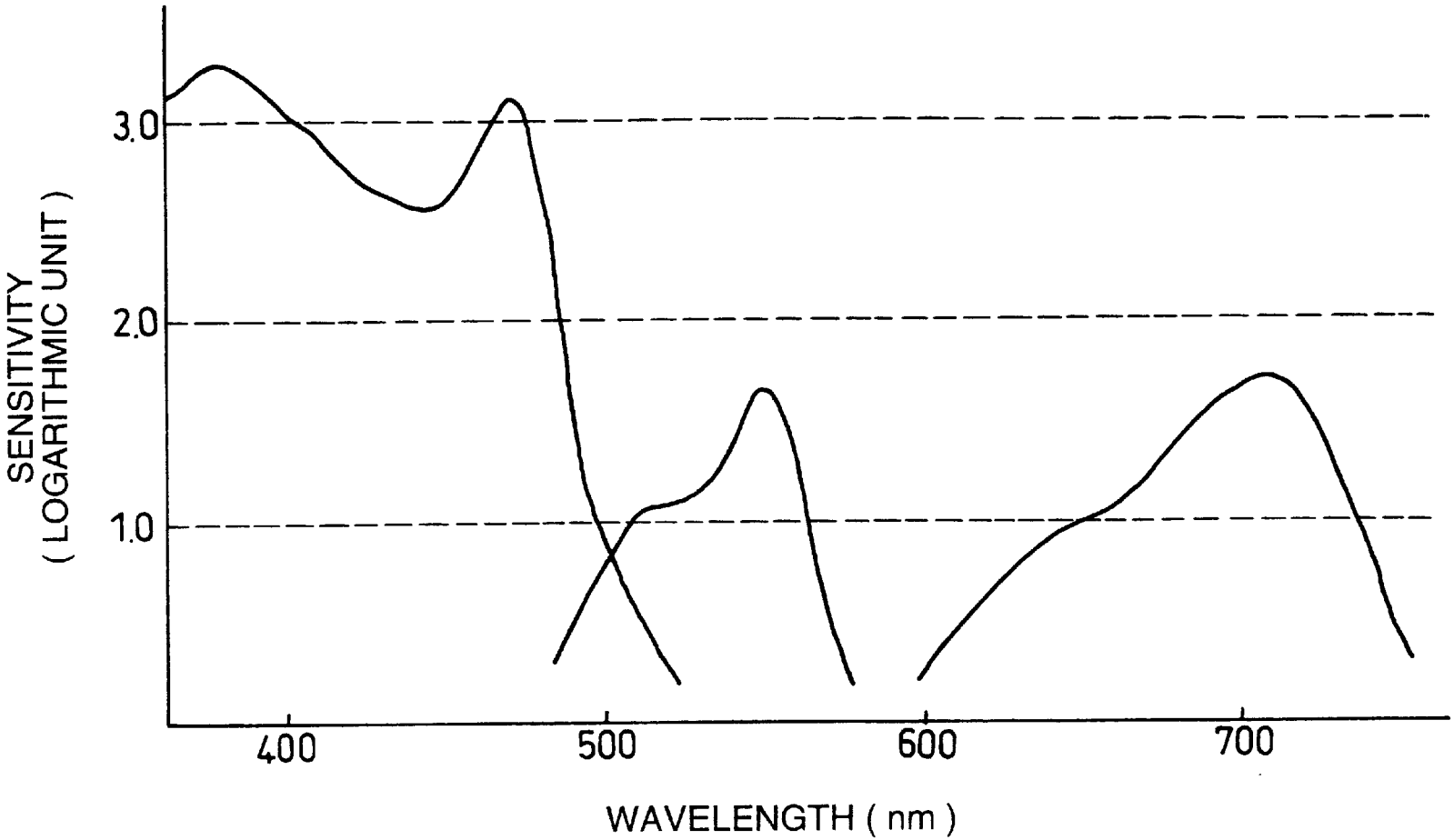
FIG. 2 is a spectral graph showing the spectral sensitivity of Photographic Material No. 102.

The spectral sensitivity curve obtained is shown in FIG. 2.

It was confirmed that the sensitivity of the green-sensitive layer of Sample No. 102 was lower than that of Sample No. 101 by 0.95 log light exposure unit, and lower than that of the red-sensitive layer by 0.08 log light exposure unit.

Example 2

Preparation of Organic Light Emitting Device

Figure 3:
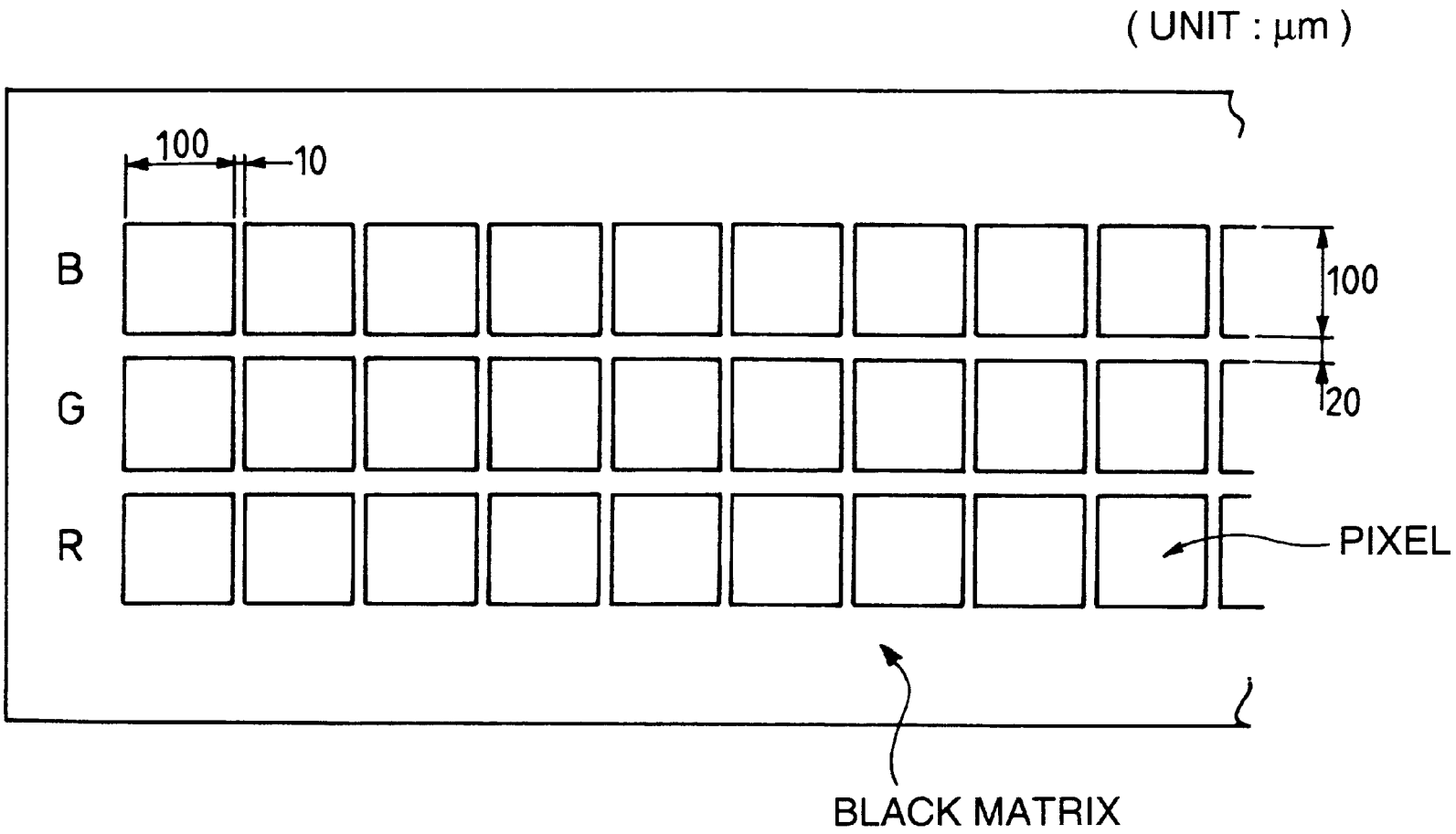
FIG. 3 is a typical view showing one example of a dot array state organic light emitting device.

Dot array state organic light emitting device for blue (B) was prepared by placing the devices the size of one pixel of which is 100 μm square, as shown in FIG. 3, in the width of 5 cm with the intervals of 10 μm.

Dot array state organic light emitting devices for green (G) and red (R) were prepared in the same manner, and intervals of each array were 20 μm. For preventing light from entering between each device and between each array, patterning was conducted to form black matrix on a transparent glass substrate (a thickness of 0.5 mm) (on the side of ITO) using negative photoresist obtained by dispersing fine particle black pigment having a particle size of 0.1 μm or less in an aqueous solution of acrylate resin.

Preparation of Dot Array Organic Luminescent Element for B

A substrate was immersed in an isopropyl alcohol (IPA) to be subjected to ultrasonic cleaning for 15 minutes, N,N'-bis(1-naphthyl)-N,N'-diphenyl-1,1'-biphenyl-4,4'-diamine (NPD) was vacuum deposited on ITO in a thickness of 40 nm, 4,4'-bis[2-(triphenylsilyl)vinyl]biphenyl was vacuum deposited thereon in a thickness of 20 nm and, further, 2-phenyl-5-(2-hydroxyphenyl)-1,3,4-oxadiazole was vacuum deposited thereon in a thickness of 40 nm. Subsequently, Mg and Ag in molar ratio of 10/1 was vacuum deposited on this organic substance layer in a thickness of 100 nm to make the cathode, further, Ag was deposited thereon in a thickness of 60 nm to protect the cathode. This dot array state organic light emitting device was sealed in an Ar glove box using glass and UV-cure resin. Electric current of 100 mA/cm$^2$ was applied to the device to emit light and the emitting spectrum of the device was measured. The peak wavelength was 455 nm and the half band width was 70 nm.

Preparation of Dot Array Organic Light Emitting Device for G

NPD was vacuum deposited on a substrate from the anode side in a thickness of 40 nm, 4-(2-naphtho[2,3-d]oxazol-2-yl-vinyl)-N,N-diphenylaniline was deposited thereon in a thickness of 40 nm, and bis(8-benzenesulfonamidoquinoline)zinc(II) was further deposited thereon in a thickness of 20 nm to prepare an organic substance layer. The cathode was deposited thereon in the same manner as in the preparation of the organic light emitting device for B, and sealed to prepare organic light emitting device for G. Electric current of 100 mA/cm$^2$ was applied to the device to emit light and the emitting spectrum of the device was measured. The peak wavelength was 550 nm and the half band width was 100 nm. Since this organic light emitting device for G causes color mixing at exposure due to big half band width, a band pass filter was used in combination with the device so as to cut the light of 500 nm or less and 600 nm or more.

Preparation of Dot Array Organic Light Emitting Device for R

Organic light emitting device for R was prepared in the same manner as in the preparation of the device for G except for using 2-(4-diphenylaminobenzylidene)-2H-cyclopenta[b]-naphthalene-1,3-dione in place of 4-(2-naphtho[2,3-d]oxazol-2-yl-vinyl)-N,N-diphenylaniline. Electric current of 100 mA/cm$^2$ was applied to the device to emit light and the emitting spectrum of the device was measured. The peak wavelength was 650 nm and the half band width was 110 nm.

Example 3

Image Formation and Evaluation

Photosensitive Material No. 101 in Example 1 was imagewise exposed with dot array state organic light emitting devices for B, G and R in Example 2, and the light amount was adjusted so that energies of B, G (in the state of using a band pass filter) and R increased in this order and to be well-balanced with the sensitivity of the photographic material. The exposed material was subjected to thermal development process similar to the manner in Example 1, thereby a color image was obtained on the image-receiving material. Exposure was performed using a selfoc lens so that the light of each device converges on the emulsion surface of the photographic material and the application time of constant current pulse was in 256 scattered levels so that each of 256 gradations can express the image (the exposure time of each device was the order of from 1 to $10^{-4}$ second). On measurement, almost no color mixture was observed on the obtained image. The degree of the color mixture of the image obtained by Photographic Material No. 102 in Example 1 was also observed in the similar manner. Since the sensitivity of the green-sensitive layer was relatively low as compared with Photographic Material No. 101, the luminance of the organic light emitting device for G was raised before exposure. As for the image obtained, not only the mixture of yellow to the magenta part was large but color mixture was also observed on the cyan, and it was confirmed that this color mixture could not be improved even if the luminance of the device was adjusted.

As is apparent from the above description, when exposure is performed by emission strengths of emission spectra of the organic light emitting devices gradually increasing from the organic light emitting device emitting light at the shortest wavelength region to the organic light emitting device emitting light at the longest wavelength region using the photographic material having three photosensitive layers each having different wavelength corresponding to the maximum spectral sensitivity, and the maximum spectral sensitivities gradually diminishing from the photosensitive layer having the maximum spectral sensitivity at the shortest wavelength to the photosensitive layer having the maximum spectral sensitivity at the longest wavelength, a color image having excellent color reproduction can be obtained.

While the invention has been described in detail and with reference to specific examples thereof, it will be apparent to one skilled in the art that various changes and modifications can be made therein without departing from the spirit and scope thereof.

What is claimed is:

1. A method for forming a color image comprising exposing a color photographic material, wherein the color photographic material comprises a support having provided thereon at least (1) a photosensitive layer capable of forming a yellow image by imagewise exposure and processing, (2) a photosensitive layer capable of forming a magenta image by imagewise exposure and processing, and (3) a photosensitive layer capable of forming a cyan image by imagewise exposure and processing, each of said photosensitive layers is sensitive to the radiant rays in the range of from 380 to 900 nm, each photosensitive layer has different wavelength corresponding to the maximum spectral sensitivity, the maximum spectral sensitivities of photosensitive layers (1) to (3) gradually diminish from the photosensitive layer having the maximum spectral sensitivity at the shortest wavelength to the photosensitive layer having the maximum spectral sensitivity at the longest wavelength, and exposure is performed by using at least three organic light emitting devices, wherein said at least three organic light emitting devices are in dot array state each having peak wavelength of emission spectrum within the wavelength region corresponding to the spectral sensitivity of each photosensitive layer, and the emission strength of emission spectrum of said organic light emitting device gradually increases from the organic light emitting device emitting light at the shortest wavelength region to the organic light emitting device emitting light at the longest wavelength region.

2. The method for forming a color image as claimed in claim 1, wherein the color photographic material further has the fourth photosensitive layer (sensitive to radiant rays in the range of from 380 to 900 nm) capable of forming or compensating for a black image by imagewise exposure and processing, and exposure is performed by further using the fourth dot array state organic light emitting device corresponding to the fourth photosensitive layer.

3. The method for forming a color image as claimed in claim 1, wherein the sensitivity difference between the photosensitive layer having the maximum spectral sensitivity at the shortest wavelength and the photosensitive layer having the maximum spectral sensitivity at the longest wavelength is larger than 0.2 log light exposure unit.

4. The method for forming a color image as claimed in claim 1, wherein each dot of each dot array state organic light emitting device emits light in at least eight scattered levels and exposure of the photosensitive layer is performed correspondingly in at least eight scattered levels.

5. The method for forming a color image as claimed in claim 1, wherein the wavelengths corresponding to the maximum spectral sensitivities of said photosensitive layers of said color photographic material are at least 50 nm apart from one another.

* * * * *